US005398931A

United States Patent [19]

Tohgoh

[11] Patent Number: 5,398,931

[45] Date of Patent: Mar. 21, 1995

[54] AUTOMATED DISPENSING APPARATUS FOR FLAT PAPER OBJECT

[75] Inventor: Mitsuaki Tohgoh, Samukawa, Japan

[73] Assignee: Toyo Communication Equipment Co., Ltd., Kanagawa, Japan

[21] Appl. No.: 169,439

[22] Filed: Dec. 16, 1993

[30] Foreign Application Priority Data

Dec. 18, 1992 [JP] Japan ..... 4-355910

[51] Int. Cl.[6] ..... B65H 1/08

[52] U.S. Cl. ..... 271/126; 271/149; 271/157; 271/162

[58] Field of Search ..... 271/9, 149, 157, 162, 271/22, 30.1, 126, 129

[56] References Cited

U.S. PATENT DOCUMENTS 3,915,338 10/1975 Kronseder et al. ..... 271/149 X
4,958,823 9/1990 Iwaki et al. ..... 271/9 X

FOREIGN PATENT DOCUMENTS 0127329 5/1990 Japan ..... 271/162
3293230 12/1991 Japan ..... 271/162

*Primary Examiner*—H. Grant Skaggs
*Assistant Examiner*—Carol L. Druzbick
*Attorney, Agent, or Firm*—Koda and Androlia

[57] ABSTRACT

Disclosed is an improved automated dispensing apparatus for flat paper object, such as ATM (Automated Teller Machines) or CD (Cash Dispensers), which can enhance the working efficiency and the service for customers. According to this apparatus, inner cassette 5 can be drawn out together with intermediate portion pushing member 12 leaving outer cassette 4 at a fixed position in the dispenser main body. While intermediate portion pushing member 12 is filled with supplementary sheet papers, the sheet papers 8 still remaining in outer cassette 4 are kept to be pushed by end portion pushing members 11*a*, 11*b*. Thereafter, when inner cassette 5 is returned into outer cassette 4, both the end portion pushing members 11*a*, 11*b* and the intermediate portion pushing member 12 are returned to the initial state for dispensing a new pile of sheet papers 8 including the supplementary ones. During that supplementation, the sheet paper dispensing operation by this apparatus can be continued without any interruption. Thus, when the supplementation of sheet papers into the paper cassette is required due to reduction of sheet papers remaining therein, the inner cassette can be drawn out leaving the outer cassette at a fixed position in the dispenser main body with the end portion pushing members working to push both end portions of the remaining sheet papers and dispense them sheet by sheet from the paying outlet. Therefore, the dispensing operation of this apparatus can be continued even on supplementing the sheet papers.

2 Claims, 9 Drawing Sheets

AUTOMATED DISPENSING APPARATUS FOR FLAT PAPER OBJECT

BACKGROUND OF THE INVENTION

1. Field of the Invention

The present invention relates to an automated dispensing apparatus for flat paper object, and particularly to a structure of paper cassette for use in ATM (Automated Teller Machines) or CD (Cash Dispensers).

2. Prior Art

Generally, in automated sheet paper dispensers such as ATM or CD, a stack of sheet papers such as bills are contained in a paper cassette, and the sheet papers are dispensed sheet by sheet from a paying outlet of a dispenser. In such an automated sheet paper dispenser, supplementation of sheet paper must be required because the number of sheets possible to fill the paper cassette at a time is limited.

In conventional automated sheet paper dispensers, it is necessary to take out the entire body of the paper cassette from the dispenser when the sheet paper is supplemented therein. Therefore, the machine operation must be stopped on that supplementation.

Thus, the impossibility of continuous non-stop operation leads to poor working efficiency and forces customers to wait until the completion of paper supplementation or to use another dispenser, thereby degrading the service.

SUMMARY OF THE INVENTION

The present invention was made in the light of the above problems. Accordingly, the object of the present invention is to provide an automated sheet paper dispenser which is improved in the working efficiency and service for customers.

In order to achieve the object, in an automated sheet paper dispenser for containing a stack of sheet papers in a paper cassette of the main body and dispensing them sheet by sheet from its paying outlet, the paper cassette comprises an outer cassette, an inner cassette which is movably disposed in the outer cassette along a stacking direction of the sheet papers, and a paper pushing mechanism for pushing the stacked sheet papers in the paper cassette toward the paying outlet, the paper pushing mechanism including the first and second end pushing members movably provided at both inner sides of the outer cassette in the same direction as the inner cassette so as to push both ends of the sheet papers and an intermediate pushing member movably provided at substantially central portion of the inner cassette in the same direction as the inner cassette so as to push substantially intermediate portion of the sheet papers.

According to the present invention, when supplementation of sheet paper is required due to the reduction of paper remaining in the paper cassette, it becomes possible to draw out only the inner cassette with the intermediate pushing member from the outer cassette leaving the outer cassette in the operative position in the main body. Even in the state after the inner cassette is drawn out, the sheet papers remaining in the outer cassette can still be dispensed sheet by sheet due to the action of the first and second end pushing members onto both ends of the sheet papers. Thus, the continuous non-stop dispensing operation from the paying outlet can be maintained even on the paper supplementation.

After the inner cassette is filled with supplementary sheet papers by placing them at a specific position on that cassette corresponding to the intermediate pushing member, it is returned again in the outer cassette together with the intermediate pushing member. In such a manner, the supplementation of sheet paper into the paper cassette can be carried out in parallel with the sheet paper dispensing operation of this machine.

DETAILED DESCRIPTION OF THE INVENTION

Hereinafter, one embodiment of the present invention will be described with reference to the drawings.

Figure 1:
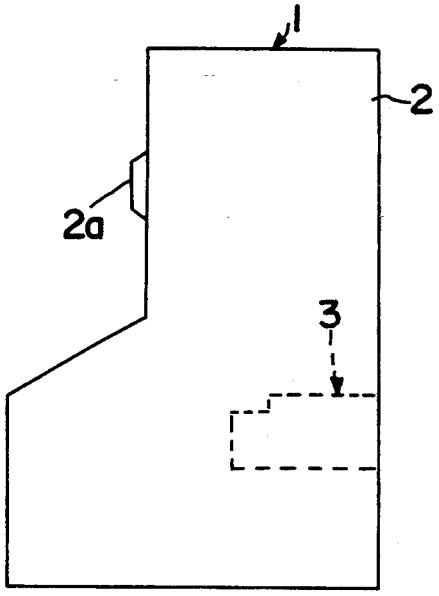
FIG. 1 is a side view of an automated sheet paper dispenser related to a first embodiment of the present invention.

FIG. 1 is a side view of an automated sheet paper dispenser related to the embodiment. In the same drawing, reference numeral 1 designates an automated sheet paper dispenser, and 2 denotes a main body of the dispenser 1.

In the main body 2, a paper cassette 3 is provided at a predetermined position. A predetermined number of sheet papers are stacked in the paper cassette 3, and the sheet papers are dispensed sheet by sheet from a paying outlet 2*a* of the main body 2 by a dispensing mechanism described below.

The paper cassette 3 is constructed as shown in FIGS. 2 to 5. The cassette 3 is comprised of an outer cassette 4, an inner cassette 5, and a paper pushing mechanism 6.

The outer cassette 4 is formed in a rectangular shape comprising a bottom wall 4*a* and side walls 4*b*, 4*c*. A paper dispensing mechanism 7, which is comprised of a plurality of rollers, is provided at the end portion of the outer cassette 4.

Figure 17:
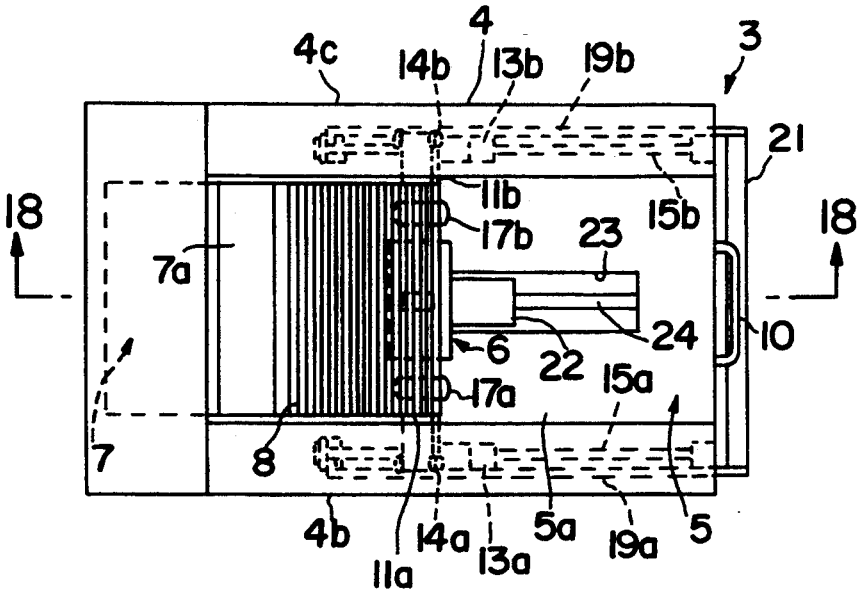
FIG. 17 is a plan view of the paper cassette in which the paper supplementation is completed (or of the initial state).
Figure 18:
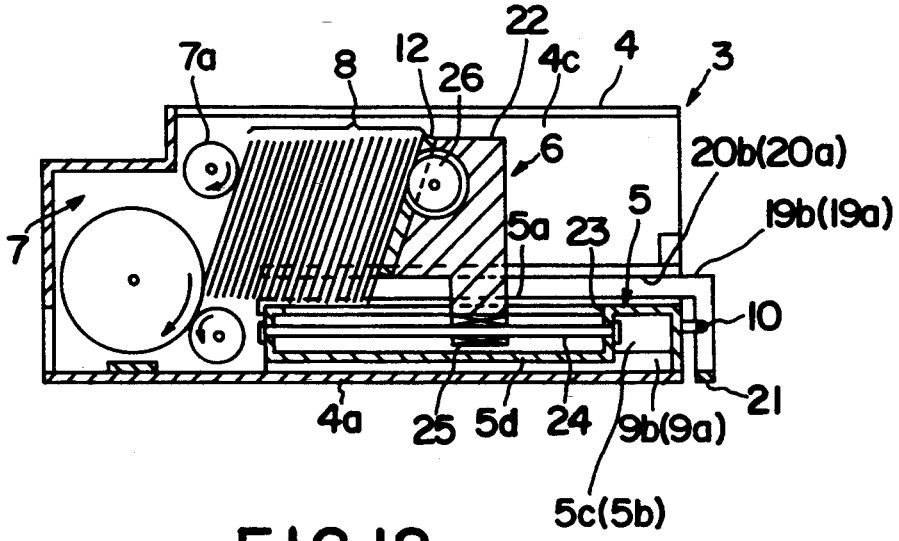
FIG. 18 is a cross-sectional side view of the paper cassette taken along the line 18—18 of FIG. 17.

As shown in FIGS. 17 and 18, a predetermined number of sheet papers 8 are stacked between the paper dispensing mechanism 7 and paper pushing mechanism 6.

Figure 2:
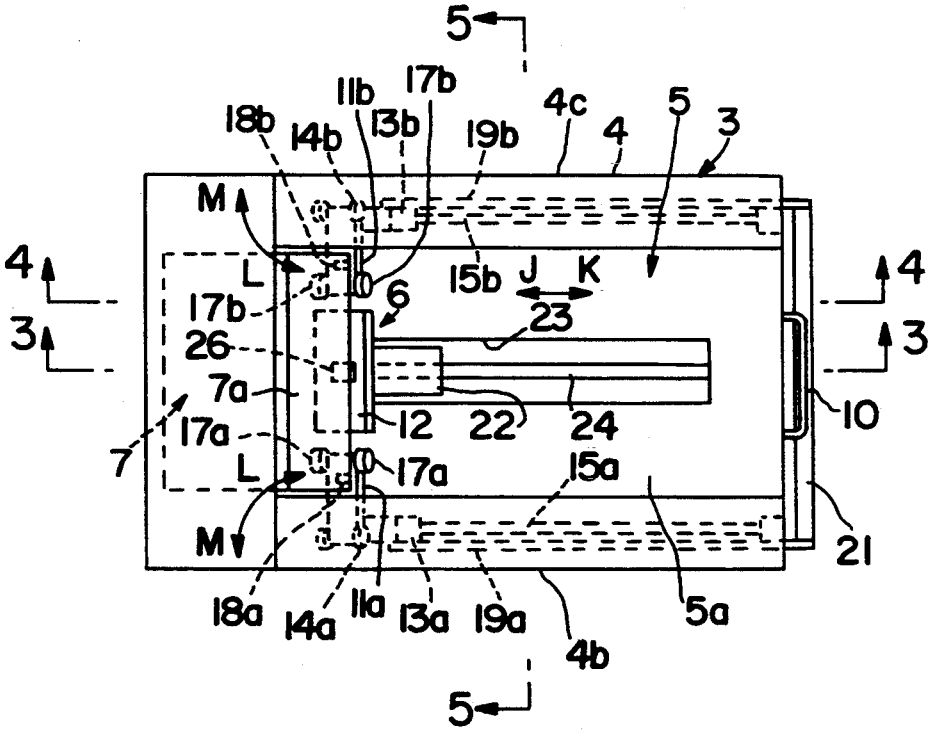
FIG. 2 is a plan view of a paper cassette in a vacant state to be incorporated in the dispenser of FIG. 1.
Figure 3:
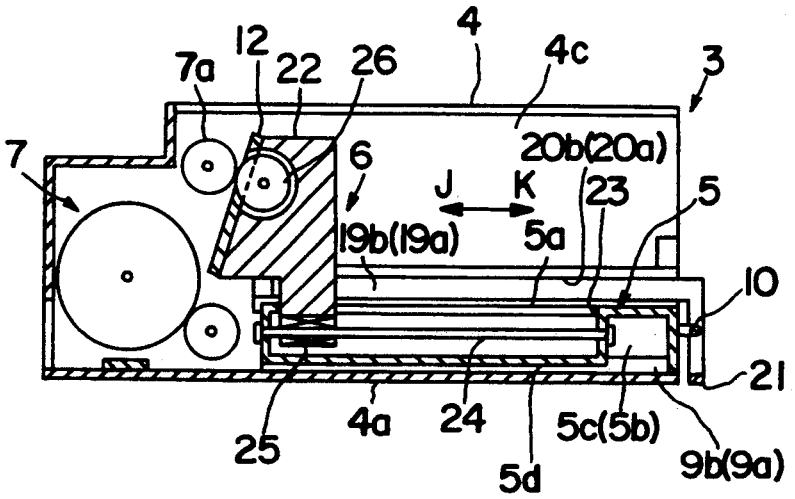
FIG. 3 is a cross-sectional side view of the paper cassette taken along the line 3—3 of FIG. 2.
Figure 4:
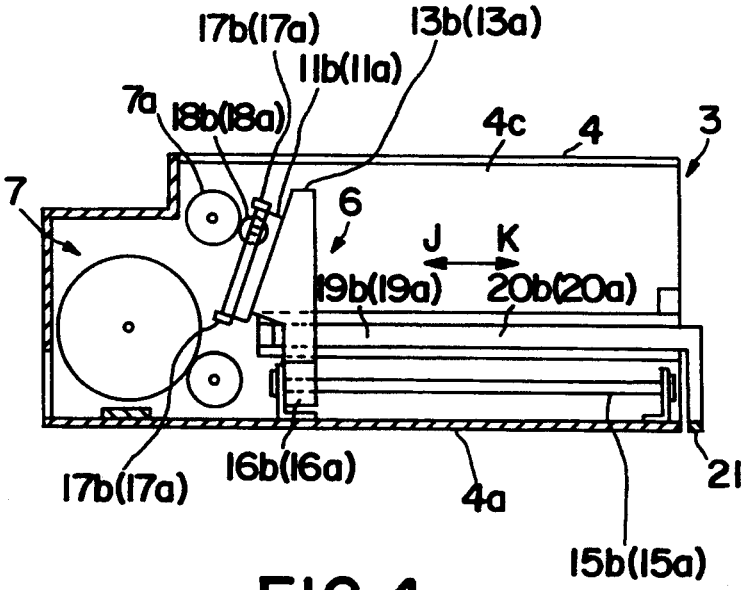
FIG. 4 is a cross-sectional side view of the paper cassette taken along the line 4—4 of FIG. 2.
Figure 5:
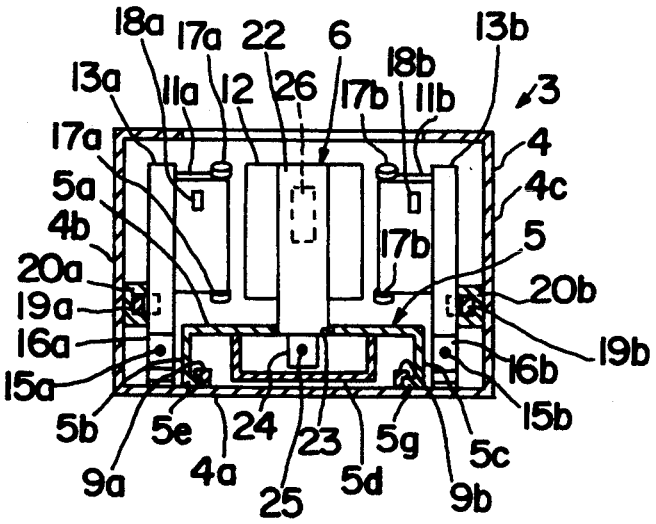
FIG. 5 is a cross-sectional side view of the paper cassette taken along the line 5—5 of FIG. 2.

The inner cassette 5 is movably provided in the outer cassette 4 in the piling direction of the sheet papers 8 (arrows J and K in FIGS. 2 to 4). The inner cassette 5 is formed in a rectangular shape comprising a paper placing wall 5*a*, side walls 5*b* and 5*c*, and an inner bottom wall 5*d* provided below the paper placing wall 5*a*. The bottom edges 5*e*, 5*g* of side walls 5*b*, 5*c* are slidably engaged with guide portions 9*a*, 9*b* which are provided on both side edges of the bottom wall 4*a* of the outer cassette 4 along the longitudinal direction, respectively.

Thus, the inner cassette 5 can move stably on the guide portions 9*a*, 9*b* leaving the outer cassette 4 at a fixed position. Therefore, an operator can draw out the inner cassette 5 by grasping and pulling a handle 10 provided on the rear face of the inner cassette 5.

When the inner cassette 5 reaches a predetermined position of the outer cassette 4, the inner cassette 5 is held by a lock mechanism (not shown) for stopping it at a predetermined position. In case of drawing out the inner cassette 5 from the outer cassette 4, the lock mechanism can be unlocked by grasping the handle 10, thereby taking out the inner cassette 5 from the outer cassette 4.

The paper pushing mechanism 6 comprises a first and second end pushing members 11*a*, 11*b* and an intermediate pushing member 12. The first and second end pushing members 11*a*, 11*b* are disposed on both sides in the outer cassette 4 so as to move in the same direction as cassette 5. The first and second end members 11*a*, 11*b* push both ends of sheet papers 8 stacked in the inner cassette 5 toward the dispensing outlet (in the direction of arrow J of FIG. 2).

Each of the first and second end pushing members 11*a*, 11*b* comprising a long and thin plate which is pivotally mounted on block members 13*a*, 13*b* by shafts 14*a*, 14*b*, and both of the first and second end pushing members 11*a*, 11*b* can be moved in the direction of arrows L, M. Further, each of the block members 13*a*, 13*b* is held on guide members 15*a*, 15*b* provided along the longitudinal direction on each side of the bottom wall 4*a* of outer cassette 4 by bearings 16*a*, 16*b* so as to slidably move in the direction of arrows J, K. In this case, the block members 13*a*, 13*b* are urged to move in the direction of arrow J by springs (not shown), respectively. Thus, the first and second end pushing members 11*a*, 11*b* can move together with the block members 13*a*, 13*b*, respectively.

In addition, the block members 13*a*, 13*b* can also move in the direction of arrow K against the spring force due to reset arms 19*a*, 19*b*. The reset arms 19*a*, 19*b* are slidably held by guide portions 20*a*, 20*b* provided along the longitudinal direction on the inner surfaces of the side walls 4*b*, 4*c*, respectively. The rear ends (right end portions shown in the drawing) of both reset arms 19*a*, 19*b* extend outward from the rear end face of the outer cassette 4, and the extended portions of the reset arms 19*a*, 19*b* are connected by a linking rod 21.

In the state shown in FIGS. 2 and 3, the end portions (left end portions shown in the drawings) of the reset arms 19*a*, 19*b* are in contact and engaged with block members 13*a*, 13*b*, respectively. Thus, by moving the reset arms 19*a*, 19*b* in the direction of arrow K, the block members 13*a*, 13*b* are moved together with the reset arms against the aforementioned spring force. In contrast, the block members 13*a*, 13*b* and reset arms 19*a*, 19*b* are moved separately in the direction of arrow J.

Further, guide rollers 17*a*, 17*b* are rotatably provided on the end portions of the first and second end pushing members 11*a*, 11*b*, respectively. Additionally, guide rollers 18*a*, 18*b* are provided on substantially central portions of the first and second end pushing members 11*a*, 11*b*, respectively.

Also the first and second end pushing members 11*a*, 11*b* are pivotally urged by springs (not shown) in the direction of arrow L to be parallel to the sheet papers 8 stacked in the cassette, respectively. The first and second end pushing members 11*a*, 11*b* can push the sheet papers 8 when the first and second end pushing members 11*a*, 11*b* are parallel to the sheet papers 8. That is, in such parallel state, each of the guide rollers 17*a*, 17*b*, 18*a*, 18*b* comes into contact with the last one of the sheet papers 8.

When the sheet papers 8 are supplemented, by moving the first and second end pushing members 11*a*, 11*b* together with block members 13*a*, 13*b* against the spring force in the direction of arrow K through the reset arms 19*a*, 19*b*, the first and second end pushing members 11*a*, 11*b* pivot respectively in the direction of arrow M against the spring biasing force to be in substantially parallel with the reset arms 19*a*, 19*b*. Thus, the first and second end pushing members can be detached outward from the rear end face of sheet papers 8.

In this case, the movement of the first and second end pushing members 11*a*, 11*b* in the directions of arrows J, K and L, M is restricted by stoppers (not shown), respectively.

The intermediate pushing member 12 is located at a central position in the traverse direction above the paper placing wall 5*a* of the inner cassette 5 to move in the same direction as inner cassette 5. The intermediate pushing member 12 pushes substantially the central portion of the stacked sheet papers 8 in the direction or arrow J (toward the dispensing outlet).

The pushing member 12 is comprised of a rectangular plate fixed obliquely to a block member 22. The bottom end of the block member 22 extends downward over the upper surface of the inner bottom wall 5*d* and moves in an opening 23 provided at substantially central portion of sheet paper placing wall 5*a* of inner cassette 5.

Further, a bearing 25 is provided at the extending end portion of the block member 22, and the bearing 25 is mounted on a guide shaft 24 provided on the upper surface of inner bottom wall 5*d* along the longitudinal direction to slide on the shaft in the direction of arrows J, K.

In addition, the intermediate pushing member 12 is urged by a spring (not shown) in the pushing direction of the sheet papers 8, i.e., the direction of arrow J, by the block member 22, and the forward movement in the direction of arrow J is restricted by a stopper (not shown). Thus, the intermediate pushing member 12 can be moved with block member 22 on the paper supplementation in the direction of arrow K to a limit position against the spring biasing force.

When the pushing member 12 reaches the limit position, it is held by a lock mechanism (not shown) to stop at that position.

Further, a guide roller 26 having a horizontal rotation axis at substantially central portion of the intermediate portion pushing member 12. The guide roller 26 and the guide rollers 18*a*, 18*b* at the central portion of both end portion pushing members 11*a*, 11*b* are in slidable contact with each other through a roller 7*a* of paper dispensing mechanism 7 and sheet paper 8.

Next, an operation of the automated sheet paper dispenser 1 will be described.

FIGS. 2 to 5 show the paper cassette 3 which does not contain any sheet paper 8, respectively, and FIGS. 17 and 18 show the paper cassette 3 in the initial state where a predetermined number of sheet papers 8 are filled in piles between the paper dispensing mechanism 7 and the paper pushing mechanism 6.

In that filled state, the first and second end pushing members 11*a*, 11*b* and intermediate pushing member 12 are in contact with the rear end sheet paper 8 to push the entire stack of the sheet papers 8 toward the paper dispensing mechanism 7 or in the direction of arrow J.

When the paper cassette 3, which is completely filled with sheet papers 8, is set in the fixed position of main body 2 as shown in FIG. 1, a driving shaft of the paper dispensing mechanism 7, which is provided at front portion of outer cassette 4, is connected to another driving mechanism on the side of main body 2.

In such a state, a customer inputs data, such as the number of sheet papers 8 to be dispensed or the like values, necessary for dispensing sheet papers 8 using a data input device (not shown) disposed on the front of main body 2. The paper dispensing mechanism 7 is then driven to dispense the sheet papers 8 stacked in the paper cassette 3 from the dispensing outlet 2*a* of main body 2 sheet by sheet from the front end one up to the number of sheet papers based on the input data given from the data input device.

In that manner, the number of sheet papers 8 stacked in the paper cassette 3 is reduced with the dispensation of sheet papers 8 from the outlet 2*a*. With that reduction, the first and second end pushing members 11*a*, 11*b* and intermediate pushing member 12 are moved in the direction of arrow J by the spring force to always push the sheet papers 8 toward the dispensing outlet.

When the number of sheet papers 8 remaining in the cassette 3 reaches a predetermined value, sheet papers 8 corresponding to the reduced amount based on the initial state shown in FIGS. 17 and 18 are supplemented again in the paper cassette 3 to refill it completely. Next, that supplementation of sheet papers 8 will be described.

Figure 6:
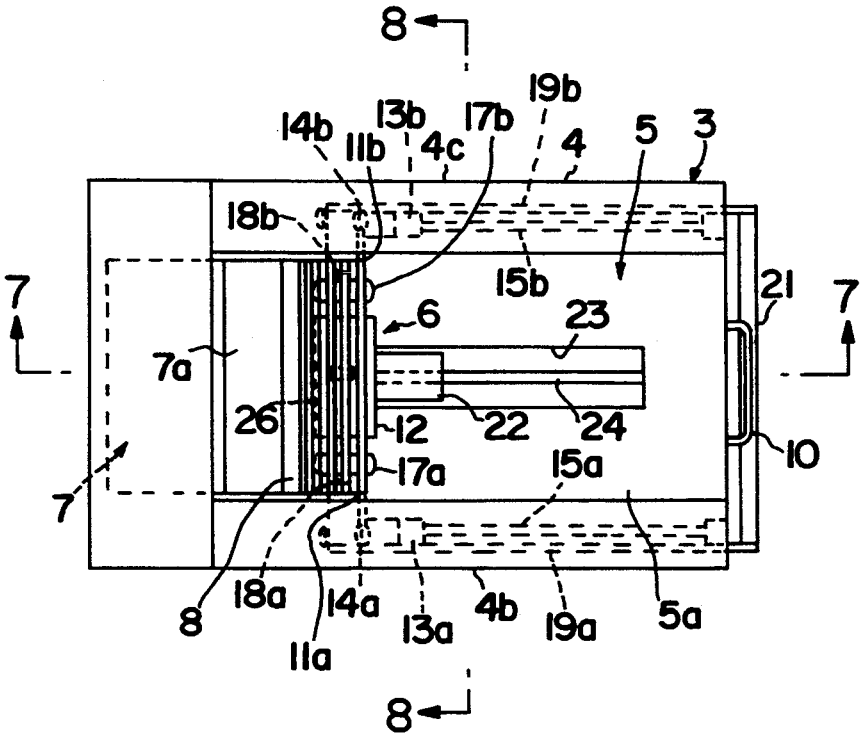
FIG. 6 is a plan view of the paper cassette in a supplemented state to be furnished in the dispenser of FIG. 1.
Figure 7:
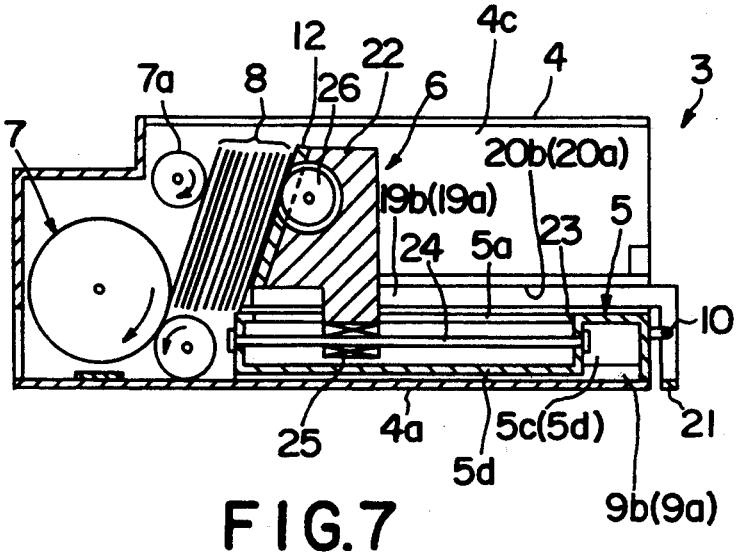
FIG. 7 is a cross-sectional side view of the paper cassette taken along the line 7—7 of FIG. 6.
Figure 8:
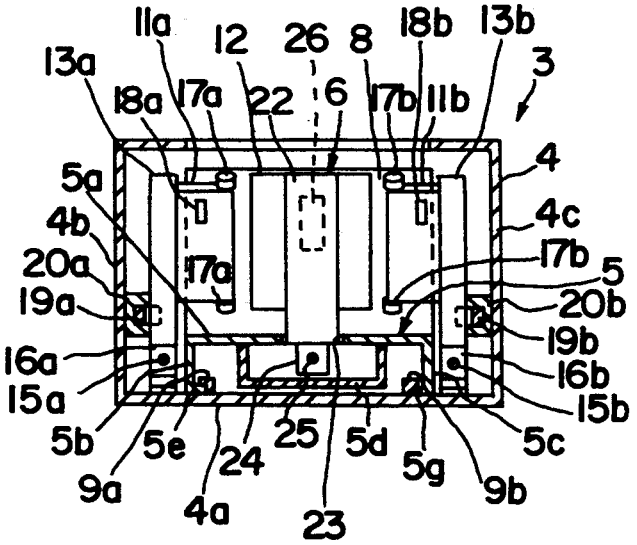
FIG. 8 is a cross-sectional side view of the paper cassette taken along the line 8—8 of FIG. 6.

FIGS. 6 to 8 respectively show the paper cassette 3 requiring supplementation of sheet papers 8 because the number of sheet papers 8 remaining in the cassette 3 reaches the predetermined value.

Figure 9:
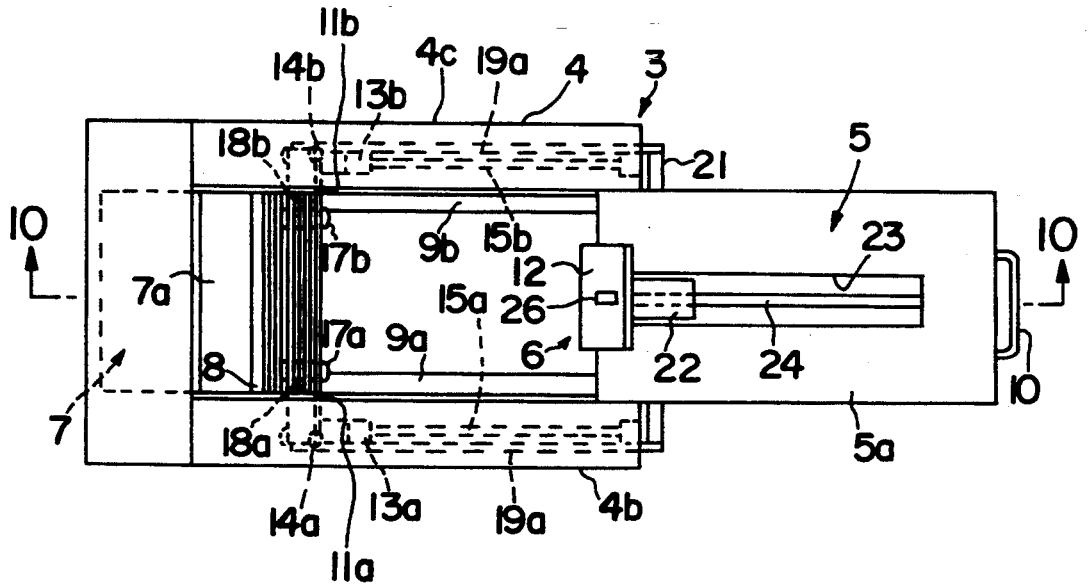
FIG. 9 is a plan view of the paper cassette of FIG. 6 from which an inner cassette is drawn out.
Figure 10:
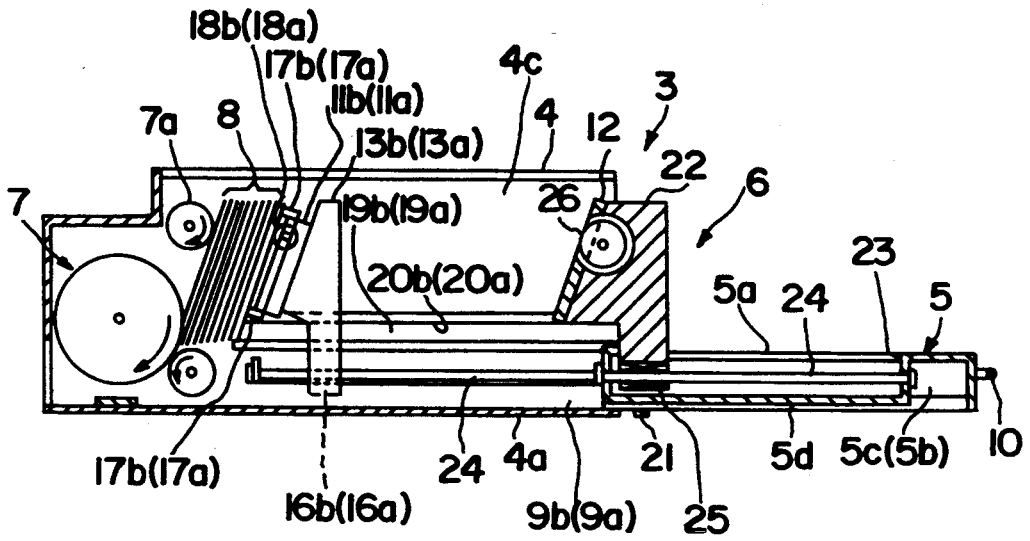
FIG. 10 is a cross-sectional side view of the paper cassette taken along the line 10—10 of FIG. 9.

In FIGS. 6 to 8, the inner cassette 5 is drawn out from the main body 2 as illustrated in FIGS. 9 and 10 by moving the cassette 5 in the direction of arrow K grasping the grasping member 10 and leaving the outer cassette 4 at a fixed position in the main body 2.

In that state, though the intermediate pushing member 12 provided in the inner cassette 5 is detached from the sheet papers 8 in the outer cassette 4, the sheet papers 8 are still pushed in the direction of arrow J by the first and second end pushing members 11*a*, 11*b* of the outer cassettes 4. Accordingly, the dispensing operation of sheet papers 8 is not discontinued by the removal of inner cassette 5.

Figure 11:
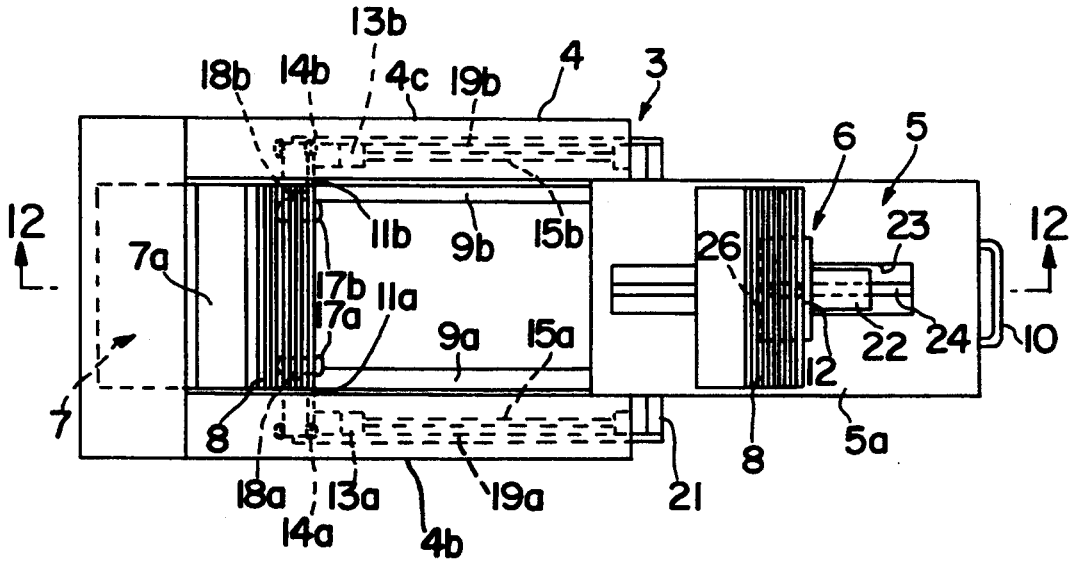
FIG. 11 is a plan view of the inner cassette of the paper cassette in the dispenser of FIG. 1, which is filled with sheet papers.
Figure 12:
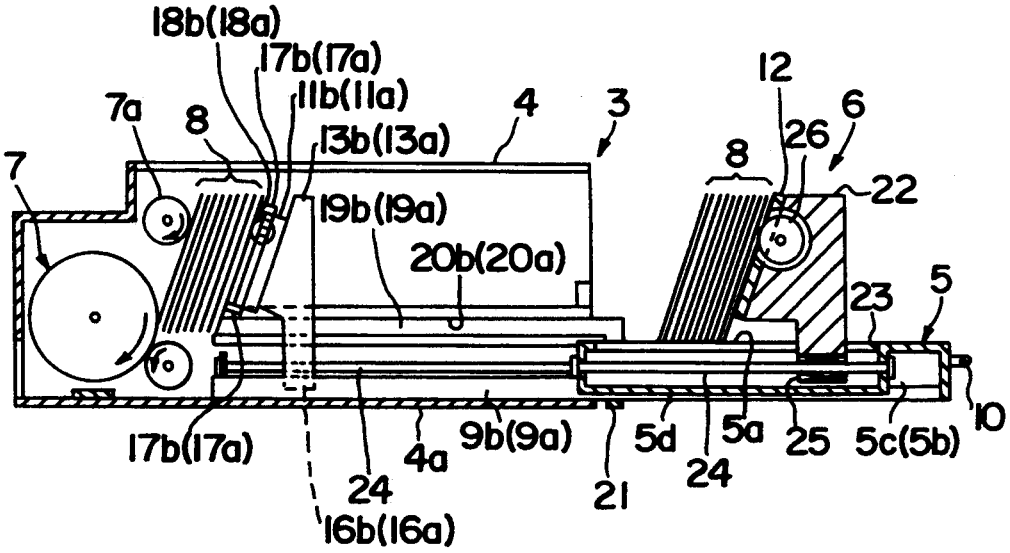
FIG. 12 is a cross-sectional side view of the inner cassette taken along the line 12—12 of FIG. 11.

When the dispenser gets a state shown in FIGS. 9 and 10, the intermediate pushing member 12 moves in the direction of arrow J by the spring force separately from the inner cassette 5 to the front end. Thereafter, when the intermediate pushing member 12 is moved in the direction of arrow K against the spring force from that front end to the rear end position, the member 12 is held by a lock mechanism at that position. In that state, a predetermined number of sheet papers 8 to be supplemented are filled in piles in the so-formed front space of intermediate portion pushing member 12 as illustrated in FIGS. 11 and 12.

After that supplementation, the inner cassette 5 is moved in the direction of arrow J to the interior of cassette 4, and the intermediate pushing member 12 is moved in the direction of arrow J due to the spring force after removal of the lock to the member 12 with the lock mechanism. With that movement, the front end of the supplemented sheet papers 8 is in contact with the rear end of the sheet papers 8 remaining in the outer cassette 4 through both the first and second end pushing members 11*a*, 11*b*.

Figure 13:
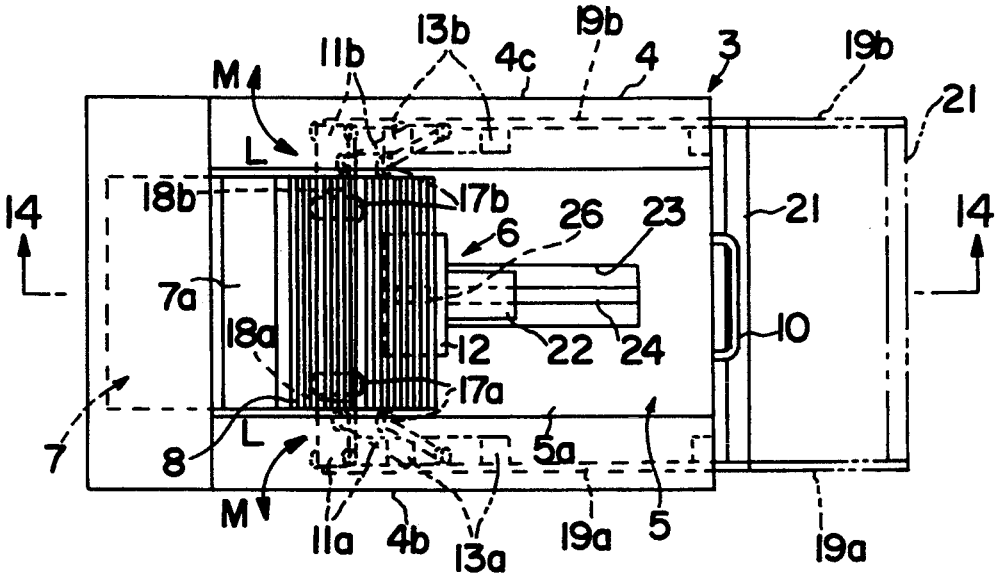
FIG. 13 is a plan view of the paper cassette in which the inner cassette is inserted in an outer cassette from the state shown in FIG. 11.
Figure 14:
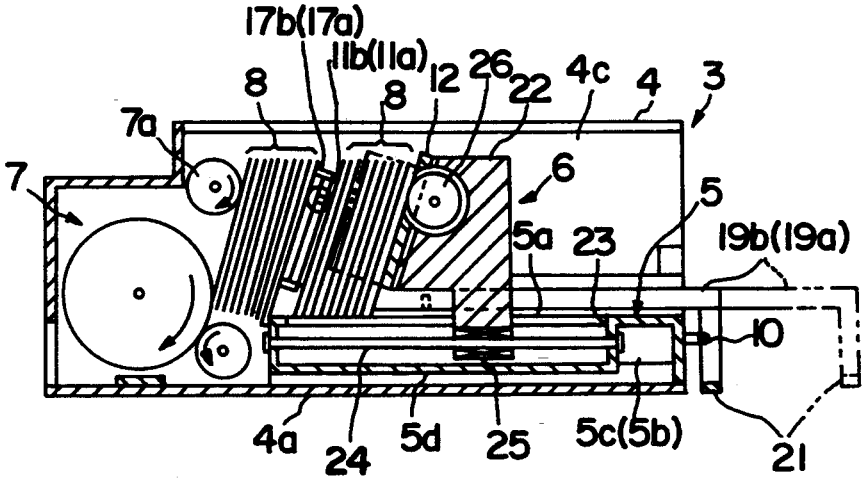
FIG. 14 is a cross-sectional side view of the paper cassette taken along the line 14—14 of FIG. 13.

Then the movement of intermediate pushing member 12 in the direction of arrow J is stopped by the contact. Thereafter, the inner cassette 5 is further moved in the direction of arrow J to a predetermined position in the outer cassette 4, and is then locked at that position as illustrated by FIGS. 13 and 14.

In that state, when the reset arms 19*a*, 19*b* are moved in the direction of arrow K against the spring biasing force, the distal ends of the arms are in contact and engaged with block members 13*a*, 13*b* of the first and second end pushing members 11*a*, 11*b*, respectively. After that engagement, when the reset arms 19*a*, 19*b* are further moved in the direction of arrow K, the first and second end pushing members 11*a*, 11*b* rotate respectively in the direction of arrow M about the axes 14*a*, 14*b* against the spring biasing force.

With that rotation, the guide rollers 17*a*, 17*b* vertically disposed at the distal ends of the first and second end pushing members 11*a*, 11*b* rotate in slidable contact with the sheet paper 8, respectively. Thus, the first and second end pushing members 11*a*, 11*b* can pivot smoothly in the direction of arrow M without damaging the sheet papers 8 to get away from the position interposed between the remaining and newly supplemented sheet papers 8 as shown by a dotted line in FIG. 13. Then, the front end of the supplemented sheet papers 8 pushed in the direction of arrow J by the intermediate pushing member 12 is in contact with the sheet papers 8 remaining in outer cassette 4 to form one continuous pile.

Figure 15:
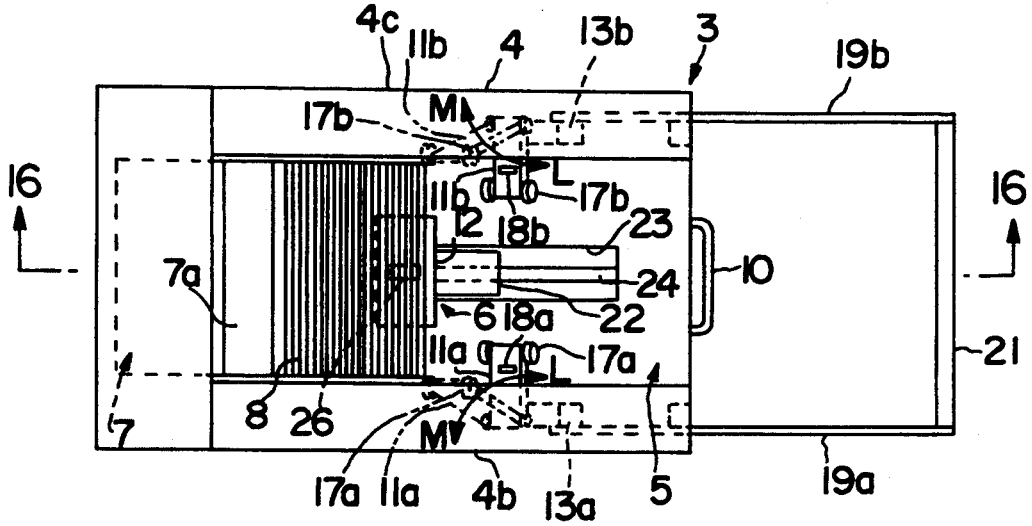
FIG. 15 is a plan view of the paper cassette in which the first pushing members are moved in the direction of arrow K from the state shown in FIG. 13.
Figure 16:
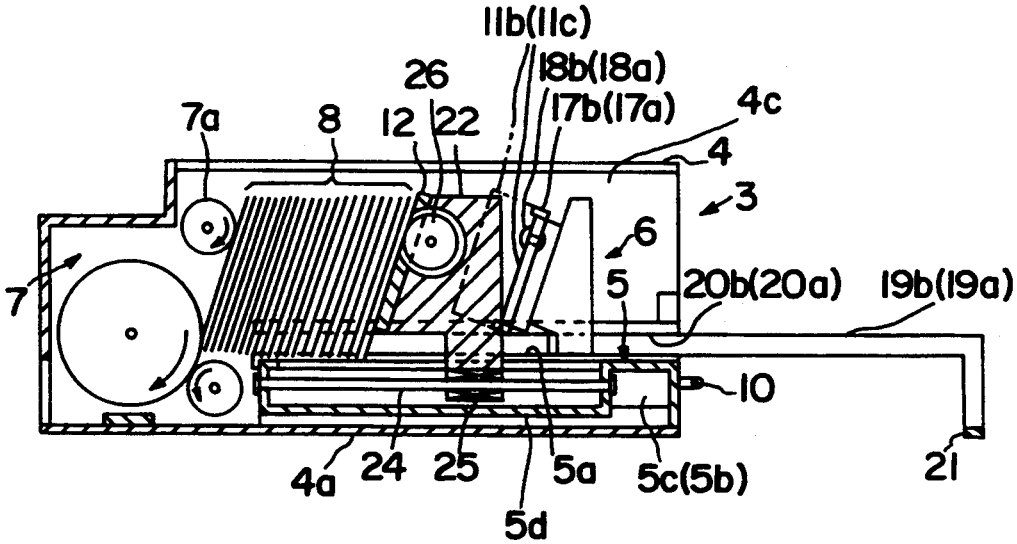
FIG. 16 is a cross-sectional side view of the paper cassette taken along the line 16—16 of FIG. 15.

When the reset arms 19*a*, 19*b* are further moved in the direction of arrow K against the spring force, the first and second end pushing members 11*a*, 11*b* move with these arms on the respective guide shafts 15*a*, 15*b* to reach the back of the rear end of supplemented sheet papers 8 as illustrated by a dotted line in FIGS. 15 and 16. Then the first and second end pushing members 11*a*, 11*b* pivot in the direction of arrow L by the spring biasing force to be in substantially parallel with the sheet papers 8 as illustrated by a solid line in FIGS. 15 and 16.

While the first and second end pushing members 11*a*, 11*b* get away from the position between the sheet papers 8 remaining in outer cassette 4 and the sheet papers 8 supplemented in inner cassette 5 and reach the back of the rear end of those supplemented sheet papers 8, the guide rollers 17*a*, 17*b* vertically disposed at the front ends of the first and second end pushing members 11*a*, 11*b* continue to rotate in slidable contact with both ends of the sheet papers 8. Thus, the movement of the first and second end pushing members 11*a*, 11*b* can be performed smoothly and will not damage the sheet papers 8.

After the first and second end pushing members 11*a*, 11*b* take the position shown by the solid line in FIGS. 15 and 16, when the reset arms 19*a*, 19*b* are moved in the direction of arrow J to the initial position in outer cassette 4, the first and second end pushing members 11*a*, 11*b* are moved with the block members 13*a*, 13*b* in the direction of arrow J by the spring force. Then, the first and second end pushing members 11*a*, 11*b* get in contact with the rear end of the stacked sheet papers 8 and push them in the direction of arrow J in cooperation with the intermediate pushing member 12 into the same state as shown in FIGS. 17 and 18.

By repeating the above operation, that is, by supplementing the sheet papers 8 by drawing out the inner cassette 5 from the outer cassette 4 without taking out the entire body of paper cassette 3 from the machine main body 2, the dispensation of sheet papers 8 from outlet 2*a* of main body 2 can be continued sheet by sheet without requiring any stop operation of the automated sheet paper dispenser 1.

In the above embodiment, the intermediate portion pushing member 12 is moved by hand to the rear end position along the direction of arrow K on supplementing the sheet papers 8, the invention is not limited to such a structure. That is, the intermediate pushing member 12 may be moved to the rear end position along the direction of arrow K by suitable driving means which can be used for moving the inner cassette 5 in the direction of arrow K.

In addition, in the above embodiment, the paper dispensing mechanism 7 is incorporated in the front end portion of the outer cassette 4, it is not limited to such a structure and may be provided on the side of the main body 2.

As stated above, according to the automated sheet paper dispenser of the present invention, the supplementation of sheet papers into the paper cassette can be carried out without stopping the dispensing operation of the main body. Thus, the continuous non-stop operation of the automated sheet paper dispenser becomes possible, thereby enhancing the working efficiency and the service for customers.

I claim:

1. An automated dispensing apparatus for flat paper objects for containing a predetermined number of flat paper objects in piles in a paper cassette incorporated in a main body of the apparatus and dispensing flat paper object one by one from its dispensing outlet, the paper cassette comprising an outer cassette, an inner cassette disposed in the outer cassette, said inner cassette being movable in a direction in which the flat paper objects are piled, and a paper pushing mechanism for pushing the flat paper objects contained in piles in the paper cassette toward the dispensing outlet, the paper pushing mechanism including end pushing portion members respectively provided on both inner sides of the outer cassette, said end portion pushing members being movable in the same direction as the inner cassette so as to push both ends of the flat paper objects and an intermediate portion pushing member provided at a substantially central portion of the inner cassette, said intermediate portion pushing member being movable in the same direction as the inner cassette so as to push a substantially intermediate portion of the flat paper objects.

2. A dispenser for sheet papers, said dispenser containing a predetermined number of the sheet papers in piles in a paper cassette and dispensing the sheet papers sheet by sheet from its dispensing outlet wherein said paper cassette comprising:

an outer cassette;

an inner cassette which is disposed in said outer cassette, said inner cassette being movable in a direction in which the sheet papers are piled;

a paper pushing mechanism for pushing the sheet papers contained in piles in the paper cassette toward the dispensing outlet;

said paper pushing mechanism including end portion pushing members and an intermediate portion pushing member;

said end portion pushing members which are respectively provided on both inner sides of said outer cassette, said end portion pushing members being movable in the same direction as said inner cassette so as to push both ends of the sheet papers;

said intermediate portion pushing member which is provided at a substantially central portion of said inner cassette, said intermediate portion pushing member being movable in the same direction as said inner cassette so as to push substantially intermediate portion of the sheet papers.

* * * * *